United States Patent [19]

Sternling

[11] Patent Number: 4,963,162

[45] Date of Patent: Oct. 16, 1990

[54] COAL GASIFICATION PROCESS

[75] Inventor: Charles V. Sternling, Houston, Tex.

[73] Assignee: Shell Oil Company, Houston, Tex.

[21] Appl. No.: 138,766

[22] Filed: Dec. 29, 1987

[51] Int. Cl.[5] ..... C10J 3/54; C10J 3/82

[52] U.S. Cl. ..... 48/203; 48/210; 48/DIG. 2

[58] Field of Search ..... 48/202, 203, 206, 209, 48/210, DIG. 2, 87, 77; 585/950; 55/82, 83, 89, 80; 201/2; 252/373; 134/20, 2, 39, ; 208/48 R, 48 Q; 110/215, 216

[56] References Cited

U.S. PATENT DOCUMENTS 4,054,424 10/1977 Staudinger et al. ..... 48/210
4,172,708 10/1979 Wu et al. ..... 48/87
4,376,694 3/1983 Lohr et al. ..... 208/48 R

FOREIGN PATENT DOCUMENTS 2112015 7/1983 United Kingdom ..... 48/DIG. 2

*Primary Examiner*—Joye L. Woodard
*Attorney, Agent, or Firm*—Albert J. Adamcik

[57] ABSTRACT

A process for the gasification of coal is disclosed, the process being characterized by the removal of flyslag deposits in the quench zone of the process by temporary reduction or stoppage of the flow of the quench gas to melt the deposits, and by diversion of a portion or all of the quench gas during the reduction or stoppage to a locus between the quench zone and the heat exchange zone.

2 Claims, 1 Drawing Sheet

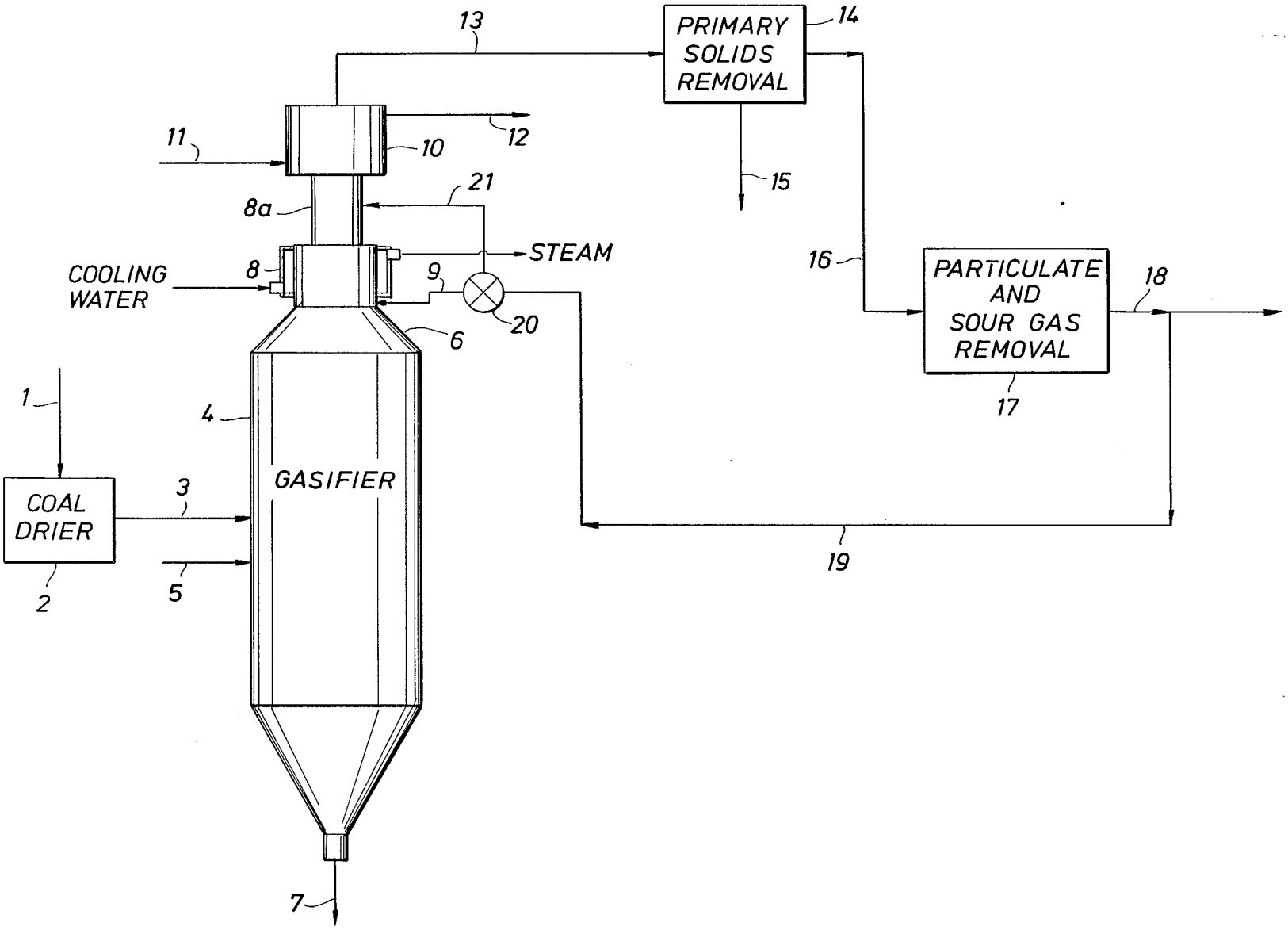
PARTICULATE AND SOUR GAS REMOVAL
PRIMARY SOLIDS REMOVAL
STEAM
GASIFIER
COOLING WATER
COAL DRIER
1
2
3
4
5
6
7
8
8a
9
10
11
12
13
14
15
16
17
18
19
20
21

COAL GASIFICATION PROCESS

In commonly assigned, copending application Serial No. 07/138,765, entitled "Process for Removal of Flyash Deposits ", by Eckstein filed even date herewith, [Attorney Docket No. T-7009,] and incorporated herein by reference, there is described a process for removing deposits of flyslag which may collect on quench zone or heat exchanger walls associated with or communicating with a reactor for the gasification of coal. A key feature in the process is the reduction or stopping of the flow of cooler quenching gas to the quench zone, and the allowing of the deposits in the quench zone to heat up sufficiently and melt.

In so doing, however, because of the highly integrated character of the total coal gasification process, including the careful balance of the quench zone, cooling zone or zones, and separation zone gas flows, the stopping or reduction of the cooler quench gas flow to the quench and cooling zone or zones will cause the system to be upset. Thus, less volume of gas will pass through the quench and cooling zone or zones, the temperatures therein will be higher, with effect downstream, and the increased final product stream volume must be taken into account. The invention overcomes these difficulties.

SUMMARY OF THE INVENTION

Accordingly, the invention relates to a process for the gasification of coal comprising (a) oxidizing particulate coal under conditions to produce synthesis gas at a temperature of from about 1050° C to about 1800° C;

(b) passing said synthesis gas to a quench zone having a wall or walls cooler than said synthesis gas, and contacting the synthesis gas with a cooler quenching gas in said quench zone, and quenching said synthesis gas, flyslag depositing on the wall surface or surfaces in contact with the synthesis gas, and recovering impure synthesis gas from said quench zone, and cooling said synthesis gas in a heat exchange zone following said quench zone, and purifying said synthesis gas;

(c) stopping or reducing the flow of cooling gas to said quench zone for a time sufficient to allow the temperature of deposited flyslag in the quench zone to increase and the flyslag to melt and flow from at least a portion of said wall surface or surfaces, and passing at least a portion of said cooling gas and cooling said synthesis gas with said cooling gas at a locus between the quench zone and the heat exchange zone; and (d) resuming the flow of the cooling gas to the quench zone as set forth in step (b). Obviously, for flow to take place, at least a portion of the walls must be non-horizontal, and, in a preferred embodiment, the walls of the quench zone are at least substantially vertical, so that melted flyslag may flow or drop to the bottom of the zone, or, if the zone is positioned above the reaction zone, into the reaction zone. The cooler quenching gas is either pure or impure cooler synthesis gas, most preferably cooler recycle synthesis gas.

DETAILED DESCRIPTION OF THE INVENTION

The partial combustion of coal to produce synthesis gas, which is substantially carbon monoxide and hydrogen, and particulate flyslag, is well known, and a survey of known processes is given in "Ullmanns Enzyklopadie Der Technischen Chemie", vol. 10 (1958), pp. 360–458. Several such processes for the preparation of hydrogen and carbon monoxide, flyslag-containing gases are currently being developed. Accordingly, details of the gasification process are related only insofar as is necessary for understanding of the present invention.

In general, the gasification is carried out by partially combusting the coal with a limited volume of oxygen at a temperature normally between 1050° C. and 2000° C. If a temperature of between 1050° C. and 2000° C. is employed, the product gas will contain very small amounts of gaseous side products such as tars, phenols and condensable hydrocarbons, as well as molten flyslag particles and salts. Suitable coals include lignite, bituminous coal, sub-bituminous coal, anthracite coal, and brown coal. Lignites and bituminous coals are preferred. In order to achieve a more rapid and complete gasification, initial pulverization of the coal is preferred. Particle size is preferably selected so that 70% of the solid coal feed can pass a 200 mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.0, preferably 0.8 to 0.9. The specific details of the equipment and procedures employed form no part of the invention, but those described in U.S. Pat. No. 4,350,103, and U.S. Pat. No. 4,458,607, both incorporated herein by reference, may be employed. Steam may or may not be employed. Accordingly, the ratio between oxygen and steam may be selected so that from 0.1 to 1.0 parts by volume of steam is present per part by volume of oxygen, although the invention is applicable to processes having substantially different ratios of oxygen to steam. The oxygen used is preferably heated before being contacted with the coal, preferably to a temperature of from about 200° C. to 500° C.

The details of the gasification reactor system form no part of the present invention, and suitable reactors are described in U.S. Pat. No. 4,202,672 and U.S. Pat. No. 4,022,591. The high temperature at which the gasification is carried out is obtained by reacting the cool with oxygen and steam in a reactor at high velocity. A preferred linear velocity of injection is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred.

After the starting materials have been converted, the reaction product, which comprises hydrogen, carbon monoxide, carbon dioxide, and water, as well as the aforementioned impurities, is removed from the reactor. This gas, which normally has a temperature between 1050° C. and 1800° C., contains the impurities mentioned and flyslag, including carbon-containing solids. In order to permit removal of these materials and impurities from the gas, the reaction product stream should be first quenched and cooled. A variety of elaborate techniques have been developed for quenching and cooling the gaseous stream, the techniques in the quench zone and primary heat exchange zone in general being characterized by use of a quench gas and boiler in which steam is generated with the aid of the waste heat. The use of a cooler quench gas for quenching the synthesis gas is described in U.S. Pat. No. 4,149,549, incorporated herein by reference. The walls of the quench zone, i.e., the external or wall surfaces not in contact with the synthesis gas, and those of the primary heat exchange zone, are cooled with steam or boiling water, and, as indicated, the wall surfaces in contact with the impure synthesis gas may collect deposits of flyslag.

In accordance with the invention, the flow of cooling or quench gas to the quench zone is reduced or stopped, and the temperature of gas passing through the quench zone is allowed to rise to a point where exposed portions of deposited flyslag formed on the quench zone walls melt. The flow is reduced, e.g., by one-half, or stopped for a length of time sufficient to melt a substantial portion of the deposits, preferably at least the bulk thereof, if not substantially all. The time needed will vary, depending on the depth of the deposits and, accordingly, a precise time needed for reduction or stoppage of the flow may not be stated. Removal of the deposits, and thus the time needed for stoppage, or reduction, may be determined, in a given case, e.g., by noting the decrease in pressure drop across the zone, or by x-ray measurements. Molten flyslag can be removed by flow through the zone, or if the quench zone is positioned above the reaction zone, by flowing down into the reaction zone, where it may be removed.

Concomitantly, the quench gas flow is diverted to a point "after" the quench zone, but preferably before the first or primary heat exchange zone, although the term "locus between" is taken to encompass the entrance to the heat exchange zone, i.e., direct or concomitant flow into the heat exchange zone. By so doing, the total gas flow and heat exchange accomplished by the quench gas are maintained in the system so that the aforementioned difficulties are not encountered.

In order to illustrate the invention more fully, reference is made to the accompanying schematic drawing. The drawing is of the process flow type in which auxillary equipment, such as valves, pumps, holding vessels, etc., have been omitted therefrom. All values are merely exemplary or calculated.

Accordingly, pulverulent coal is passed via line (1) into a coal dryer (2) where the coal is dried, suitably at a temperature of about 200° C. The dry coal is subsequently discharged through a line (3) and passed into a gasification reactor (4) where it is gasified at a temperature of about 1500° C. to about 2000° C., a pressure of 15 to about 35 atmospheres absolute, with oxygen, which is supplied through a line (5). The gasification produces a product or synthesis gas which is removed from the upper portion (6) of the reactor, and a slag which is removed in large part from the lower portion of the reactor via line (7). The gasification product is removed via conduit or quench zone (8) where it is quenched by cooled synthesis gas supplied via line (9) and then passed through a duct or conduit 8*a* through a boiler or heat exchange zone (10) where it is cooled to a temperature of about 200° C. In the heat exchange zone (10), water, which is supplied through line (11), is converted by indirect heat exchange to high pressure steam, the steam being discharged through a line (12). The cooled gasification product is passed through a line (13) to a series of cyclones (14) or other equipment for removal of particulate matter, such as bag filters, where the bulk of the particulates (flyslag) is removed and sent via line (15) to storage. The synthesis gas then passes via line (16) to a series of purification steps designated as (17) where a final, cooled product synthesis gas is removed via line (18). A portion of the cooled gas is recycled via line (19) to quench zone (8) for quenching the hot gas from reactor (4). Preferably, however, a partially cooled, impure gas is removed and utilized (not shown).

In accordance with the invention, when it is determined by increased pressure drop that deposits are present on the inner walls of zone (8), valve (20) is actuated, stopping flow of quench or cooling gas in line (9) and directing the gas via line (21) to the duct 8*a* between quench zone (8) and primary heat exchange zone (10). Valve (20) remains in this position until pressure drop measurement across zone (8) indicates that the zone has been at least substantially cleared, e.g., about 10 to 180 minutes.

While the invention has been illustrated with particular apparatus, those skilled in the art will appreciate that, except where specified, other equivalent or analogous units may be employed. The term "zone", as employed in the specification and claims, includes, where suitable, the use of segmented equipment operated in series, or the division of one unit into multiple units to improve efficiency or overcome size constraints, etc. For example, a series of scrubbers might be employed, with different aqueous solutions, at least the bulk of the "loaded" solutions being sent to one or more strippers. Parallel operation of units, is, of course, well within the scope of the invention.

What is claimed is:

1. A process for the gasifiction of coal comprising (a) oxidizing particulate coal under conditions to produce impure synthesis gas at a temperature of from about 1050° C. to about 1800° C. and containing molten flyslag;

(b) passing said synthesis gas to a quench zone having a wall or walls cooler than said synthesis gas;

(c) contacting the impure synthesis gas with a cooler quenching gas in said quench zone, and quenching said synthesis gas, flyslag depositing on the wall or walls in contact with said synthesis gas;

(d) recovering impure quenched synthesis gas from said quench zone;

(e) cooling said quenched synthesis gas in a heat exchange zone following said quench zone, and purifying said synthesis gas;

(f) reducing or stopping the flow of cooler quenching gas to said quench zone for a time sufficient to allow the temperature of deposited flyslag in the quench zone to increase and the flyslag to melt and flow from at least a portion of said wall or walls through the quench zone;

(g) passing at least a portion of said cooler quenching gas and cooling said synthesis gas with said cooler quenching gas at a locus between the quench zone and the heat exchange zone; and (h) resuming the flow of cooler quenching gas to the quench zone as set forth in step (c).

2. The process of claim 1 wherein wall or walls of the quench zone are at least substantially vertical.

* * * * *